US008506357B2

(12) United States Patent
Himmelsbach

(10) Patent No.: US 8,506,357 B2
(45) Date of Patent: Aug. 13, 2013

(54) METHOD FOR GRINDING THE MAIN AND ROD BEARINGS OF A CRANKSHAFT BY EXTERNAL CYLINDRICAL GRINDING AND APPARATUS FOR CARRYING OUT THE METHOD

(75) Inventor: Georg Himmelsbach, Haslach (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 308 days.

(21) Appl. No.: 12/865,370

(22) PCT Filed: Jan. 13, 2009

(86) PCT No.: PCT/EP2009/050321

§ 371 (c)(1),
(2), (4) Date: Jul. 29, 2010

(87) PCT Pub. No.: WO2009/095299

PCT Pub. Date: Aug. 6, 2009

(65) Prior Publication Data

US 2011/0003534 A1 Jan. 6, 2011

(30) Foreign Application Priority Data

Feb. 1, 2008 (DE) ..... 10 2008 007 175

(51) Int. Cl.
*B24B 51/00* (2006.01)
*B24B 5/42* (2006.01)

(52) U.S. Cl.
USPC ..... 451/11; 451/62; 451/49

(58) Field of Classification Search
USPC ..... 451/11, 399, 49, 5, 57, 62; 700/164; 82/106

IPC ..... B24B 5/42
See application file for complete search history.

(56) References Cited

U.S. PATENT DOCUMENTS 3,583,108 A * 6/1971 Oishi et al. ..... 451/399
3,595,131 A * 7/1971 Rozanek et al. ..... 409/84
3,793,687 A * 2/1974 Berbalk ..... 29/888.08
3,839,829 A * 10/1974 Price ..... 451/249

(Continued)

FOREIGN PATENT DOCUMENTS

DE 43 27 807 3/1995
DE 197 14 677 10/1998

(Continued)

*Primary Examiner* — Joseph J Hail
*Assistant Examiner* — Tyrone V Hall, Jr.
(74) *Attorney, Agent, or Firm* — Jordan and Hamburg LLP

(57) ABSTRACT

In the cylindrical grinding of the main and rod bearings of crankshafts, the rod bearings are ground prior to the main bearings. The advantage of this is that the deformations that unavoidably occur, mainly during grinding of the rod bearings due to the removal of ground material are taken into account and compensated for again during grinding of the main bearings. The rod bearings are ground through CNC-control in the pin-chasing grinding method, and the crankshaft is held in a rotating axis in the process, said axis defined by two bearing points in the longitudinal extension of the crankshaft main bearing which are only machined. Deviations in said actual rotating axis from the determining geometric longitudinal axis of the crankshaft are taken into account in the pin-chasing grinding method by the computer of the grinding machine. The finished ground rod bearings then have an exact relation to the main bearings, which would have been ground strictly according to the determining geometric longitudinal axis of the crankshaft.

15 Claims, 5 Drawing Sheets

(56) References Cited

U.S. PATENT DOCUMENTS

| | | | | | |
|---|---|---|---|---|---|
| 4,366,543 | A | * | 12/1982 | Feller et al. | 700/193 |
| 4,375,670 | A | * | 3/1983 | Kralowetz et al. | 700/164 |
| 4,384,333 | A | * | 5/1983 | Maecker | 700/164 |
| 4,774,746 | A | * | 10/1988 | Blaimschein | 29/26 A |
| 4,884,210 | A | * | 11/1989 | Blaimschein | 700/159 |
| 5,189,846 | A | * | 3/1993 | Griswold | 451/364 |
| 5,235,838 | A | * | 8/1993 | Berstein | 148/510 |
| 5,408,745 | A | * | 4/1995 | Tomiyama et al. | 29/888.08 |
| 5,681,208 | A | | 10/1997 | Junker | |
| 5,984,599 | A | * | 11/1999 | Janssen | 409/199 |
| 6,149,502 | A | * | 11/2000 | Shimomura | 451/49 |
| 6,411,861 | B1 | * | 6/2002 | Clewes et al. | 700/164 |
| 6,568,096 | B1 | * | 5/2003 | Svitkin et al. | 33/550 |
| 6,698,095 | B1 | * | 3/2004 | Assie | 29/888.08 |
| 6,711,829 | B2 | * | 3/2004 | Sano et al. | 33/549 |
| 6,742,252 | B1 | | 6/2004 | Santorius et al. | |
| 6,878,043 | B1 | | 4/2005 | Junker | |
| 2002/0066197 | A1 | | 6/2002 | Sano et al. | |
| 2004/0023600 | A1 | | 2/2004 | Horsky et al. | |
| 2006/0121830 | A1 | * | 6/2006 | Hori et al. | 451/11 |
| 2010/0173565 | A1 | * | 7/2010 | Junker | 451/11 |
| 2010/0203805 | A1 | * | 8/2010 | Junker | 451/5 |

FOREIGN PATENT DOCUMENTS

| | | | |
|---|---|---|---|
| DE | 100 52 443 | | 5/2002 |
| DE | 103 04 252 | | 8/2004 |
| DE | 102007026562 | A1 * | 12/2008 |
| EP | 76635 | A1 * | 4/1983 |
| EP | 1 181 132 | | 2/2002 |
| GB | 2 317 130 | | 3/1998 |

* cited by examiner

METHOD FOR GRINDING THE MAIN AND ROD BEARINGS OF A CRANKSHAFT BY EXTERNAL CYLINDRICAL GRINDING AND APPARATUS FOR CARRYING OUT THE METHOD

BACKGROUND OF THE INVENTION

The invention relates to a method for grinding the main and rod bearings of a crankshaft by external cylindrical grinding.

Crankshafts made of steel or cast materials are mass-produced for the internal combustion engines of motor vehicles. An important factor here, in addition to economical mass production, is in particular the greatest possible accuracy with regard to diameter, roundness and centricity. Very high demands are therefore imposed on grinding methods of said type. According to EP 1 181 132 B1, it has already been recognized that the grinding result can be improved by the main and rod bearings of the crankshafts being ground in a very specific sequence.

This is because stresses are released during the grinding of the crankshafts, which to begin with are only machined by chip removal, and these stresses lead to the deformation of the crankshaft blanks during the grinding. The deformations after the grinding of the rod bearings are especially pronounced. It has therefore been proposed according to EP 1 181 132 B1 to finish-grind the rod bearings as far as possible at an early stage. The instruction is therefore given to firstly rough-grind the main bearings, then rough- and finish-grind the rod bearings and lastly finish-grind the main bearings. The known method has the advantage that deformations of the crankshaft which originate from the grinding of the rod bearings can partly be removed again during the finish grinding of the main bearings. In addition, the known method can be carried out in a single setup of the crankshaft. In this known method, the grinding started with the rough grinding of the main bearings so that the crankshaft is clamped in a precisely defined rotation axis, namely its defining geometrical longitudinal axis, for the grinding of the rod bearings. This defining geometrical longitudinal axis must be available as a reference axis for the machining of the rod bearings. On a finish-ground crankshaft, all the main bearings and also other regions of the crankshaft that are arranged concentrically to the main bearings must be oriented exactly according to the defining geometrical longitudinal axis of the crankshaft with regard to diameter, roundness, true running and centricity. The same applies to the center line of the crank journals, which again is a defining geometrical longitudinal axis for the rod bearings.

To this end, the existing geometrical longitudinal axis is established by means of centering bores at the end faces of the crankshaft. The crankshaft is clamped between centers at its centering bores and is rotationally driven by a driving device. This type of clamping has the disadvantage that a certain axial pressure has to be exerted on the crankshaft, as a result of which there is the risk of additional deformations because the crankshaft bends under the effect of an axial pressure. It is therefore necessary to also place one or more steady rests.

Attempts have also already been made to exert an axial pull on the crankshaft during the clamping of the latter. But there is still the disadvantage that additional deformations can occur during the first stage of the method according to EP 1 181 132 B1. An optimum grinding result is again made more difficult as a result; in addition, the known method thus becomes more complicated again.

SUMMARY OF THE INVENTION

The object of the invention is therefore to improve the known method for grinding the main and rod bearings of crankshafts in such a way that the accuracy of the grinding result is further improved in a procedure that is still economical.

The method according to the invention for grinding the main and rod bearings has the advantage that all the rod bearings of the crankshaft are already ground to finished size in the first method stage by CNC-controlled external cylindrical grinding. Experience shows that the greatest deformation of the crankshaft, this deformation originating from the release of stresses, therefore occurs right at the start of the grinding. After that, the stresses in the crankshaft have been completely removed and further appreciable distortion no longer occurs. Only after that is the grinding of the main bearings started, wherein there is still the greatest possibility for correction. During the grinding of the main bearings themselves, far smaller deformations occur than during the grinding of the rod bearings.

The invention achieves this result in a surprising manner by already dispensing with the rotation of the crankshaft about the defining geometrical longitudinal axis during the grinding of the rod bearings. This longitudinal axis is certainly known and is established by centering bores located on the end faces of the crankshaft. However, the crankshaft is clamped at two unground bearing points which are at a distance from one another in the common longitudinal extent of the main bearings. The clamping is accomplished, for example, by shell chucks, which comprise the two unground bearing points, always without exerting an axial pressure on the crankshaft. These two bearing points define an actual rotation axis, the deviation of which from the defining geometrical longitudinal axis of the crankshaft is known by measurement. The known deviation is taken into account as a correction function in the computer of the CNC control during the grinding of the rod bearings. The finish-ground rod bearings then have an exact reference to main bearings of the crankshaft, which would be ground strictly according to the defining geometrical longitudinal axis of the crankshaft.

Following the finish grinding of the rod bearings, the setup of the crankshaft is changed and a second setup is prepared in which the crankshaft is clamped at its axial ends and is rotationally driven about its defining geometrical longitudinal axis; in this second setup, all the main bearings are ground to the finished size by external cylindrical grinding.

In the method according to the invention, the grinding in a single setup is therefore dispensed with. However, this disadvantage is easily compensated for by a greater accuracy in the grinding result with regard to diameter, roundness, true running and centricity. Comparative tests of the applicant have shown that a true-running tolerance at the central main bearings of conventional crankshafts, which hitherto was around 0.05 mm, could be improved to about 0.03 mm by the method according to the invention.

The blanks of the crankshaft are advantageously pre-machined by chip removal, then the pre-machined bearing points provided for the first setup are measured with regard to diameter, roundness and centricity and a correction function is formed for the pin-chasing grinding process of the rod bearings from the deviation of the measured values from the defining geometrical longitudinal axis.

For the practical implementation of the method, it is advantageous if centering bores are provided at the end faces of the crankshaft in order to determine the position of the geometrical longitudinal axis, at which centering bores the crankshaft can be clamped in a centering manner in a grinding machine.

Furthermore, it is advantageous if a radially running straight line starting from the defining geometrical longitudinal axis is established as a reference line for the angular position of the measured values and a reference bore in an end face of the crankshaft is measured for this purpose.

Suitable bearing points for the clamping of the crankshaft during the grinding of the rod bearings are the two outer main bearings or other end cylindrical sections which lie in the same common longitudinal extent as the main bearings.

In the first setup, the two suitable bearing points of the crankshaft are advantageously mounted in shell chucks of a grinding machine and as a result the crankshaft is rotationally driven at its two ends. In this case, the drives at the two ends of the crankshaft—normally work headstock and footstock—are driven in an exactly synchronized manner by the machine control.

The grinding of the rod bearings in the pin-chasing grinding process can be carried out with a single grinding wheel which serves for the rough grinding right through to the finish grinding and is used successively at the various rod bearings. However, a pin-chasing grinding process in which a plurality of grinding wheels are used simultaneously is especially economical. For example, in four-cylinder engines, two respective rod bearings have the same phase position with respect to the defining geometrical longitudinal axis. Therefore two respective rod bearings can be ground simultaneously and with the same radial infeed movement onto the crankshaft. In this case, first of all the two inner rod bearings and then—after the two grinding wheels are moved apart axially—the two outer rod bearings are ground. It is also possible to attach two grinding spindles to a single cross slide, which are used simultaneously but with a different radial infeed to two rod bearings having different or identical phase position.

According to a further advantageous configuration, the main bearings can also be ground in a CNC-controlled manner.

The main bearings are ground in the second setup of the crankshaft, in which the latter is advantageously clamped between locating centers and is rotationally driven by driving devices at least at its work-headstock end. The driving devices in this case advantageously consist of compensating chucks, the chuck jaws of which automatically abut against the still unground clamping point and compensate for irregularities and dimensional deviations in the process. Such compensating chucks are based on the action of a pneumatic or hydraulic pressure medium and are known. The interaction between the locating centers and the centering bores located on the crankshaft then always ensures that the crankshaft rotates exactly about its defining geometrical longitudinal axis in the second setup.

The clamping of the crankshaft between the locating centers has no adverse effects on the grinding result if the main bearings are ground after the rod bearings. This is because the deformations of the crankshaft which originate from the release of stresses are now already complete. In so far as they have an effect on the accuracy of the main bearings, these inaccuracies are removed again by the finish grinding of the main bearings. It is therefore essential for the method according to the invention that the crankshaft, in the first method stage, is clamped at two unground bearing points which are at a distance from one another in the common longitudinal extent of the main bearings, without clamping being effected by locating centers. For example, rigid clamping of the crankshaft is accomplished in this case by shell chucks without an axial pressure having to be exerted on said crankshaft. It is therefore essential for the method according to the invention that the specified different clamping has to be effected in each case in the two method stages.

The circumferential grinding of the main bearings in the second setup is effected in an especially economical manner using a multiple grinding wheel set, the grinding wheels of which are located on a common driven spindle and have the same diameter. However, it is also possible to carry out the second machining stage using a single grinding wheel which is fed in successively to the individual main bearings.

If required by the design of the crankshaft, support can be provided by means of one or more steady rests in the second method stage.

The invention also deals with apparatuses for carrying out the method according to the invention. In principle, the method according to the invention does not have to be carried out in a specific apparatus. For example, the delivered crankshaft blanks merely machined by chip removal can be measured in a measuring station and then brought by in-house transport to a first grinding machine in which the pin-chasing grinding of the rod bearings takes place. There may in turn be a further grinding machine at another location, in which the crankshaft only finish-ground at the rod bearings is now ground at the main bearings.

In most cases, there will be a common installation of measuring station and first and second grinding stations. An especially advantageous apparatus for carrying out the method according to the invention is specified in claim 14. A common grinding cell having a first and a second grinding station enables driving, control, cooling and transport devices, which have to be present in both requisite grinding stations, to be combined in an economical manner. The arrangement of the measuring station directly upstream is also advantageous in this case.

Finally, it should be emphasized that, with the grinding operations provided according to the invention, the circumferential grinding of the crankshaft at least at the diameters of main and rod bearings is complete and no further grinding has to be carried out. Normal grinding wheels on a corundum and CBN basis can be used.

The invention will subsequently be explained in more detail with reference to an exemplary embodiment shown in the drawings, in which:

DETAILED DESCRIPTION OF THE INVENTION

Figure 1:
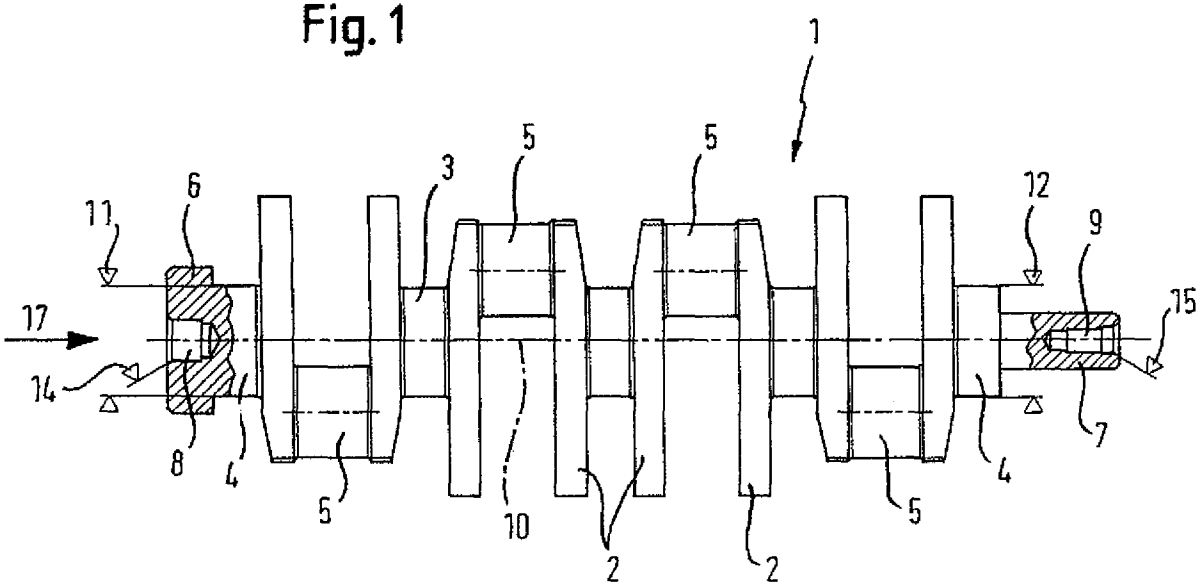
FIG. 1 shows the side view of a crankshaft and serves to explain the measurements which are required before the grinding of the crankshaft.

A side view of a crank shaft 1 is shown in FIG. 1. As is customary, it has cheeks 2, inner main bearings 3 and outer main bearings 4 and also rod bearings 5. A flange 6 is located at one end of the crankshaft 1 and a journal 7 at the other end. The crankshaft 1 has a defining geometrical longitudinal axis 10 which forms the theoretical center line of the crankshaft 1.

The centering bores 8 and 9, which are present when measuring of the crankshaft blank is started, also lie in this defining geometrical longitudinal axis 10.

At this point in time, the cast or forged crankshaft 1, made of steel or cast materials, is first machined by chip removal, in particular by turning, drilling or trochoidal milling. In the process, the bearing points which are to serve for the first setup during the grinding usually do not lie exactly in the defining geometrical longitudinal axis 10 which is established by the center bores 8 and 9. In the present example, a setup at the outer main bearings 4 is provided. Said main bearings 4 are therefore used as measuring points 11, 12, at which diameter, roundness and centricity are measured. The measured values are determined in relation to the circumferential angle at each measuring point 11, 12 and are stored.

Each crankshaft 1 is measured individually. Measuring and storing are effected in a measuring station 13, which can be located directly next to a grinding machine, cf. FIG. 3. The measured values are then transferred directly into the computer of the grinding machine. However, it is also possible to carry out the measurement separately from the grinding machine. In this case, a storage medium which contains the test record is attached to the crankshaft 1 during transport in-house.

The center points of the two bearing points which lie in radial transverse planes and which are provided for by the two main bearings 4 are measured at the two measuring points 11 and 12 on the basis of these measurements. The connection between the two center points results in the rotation axis of the crankshaft 1 in the first setup. Furthermore, there is a respective taper 14, 15 in the centre bores 8 and 9 for subsequently attaching the locating centers 52, 53 in the second setup, cf. FIG. 7.

For the grinding operation, not only must the radial position of the center point of the defining geometrical longitudinal axis 10 be known at each clamping point, that is to say at the two outer main bearings 4, in relation to the circumferential angle, but the initial rotary position of the crankshaft 1 to be ground, that is to say the zero position of the circumferential angle, must be established. To this end, a reference bore 16, for example, in the end face of the flange 6 is measured following the measuring of the crankshaft 1. The crankshaft 1 can thus be fed to the grinding machine and clamped in a pre-oriented rotary position. The arrangement of the reference bore 16 can be seen from FIG. 2. The reference bore 16 is present in addition to fastening bores 18 which are in the flange 6.

Figure 2:
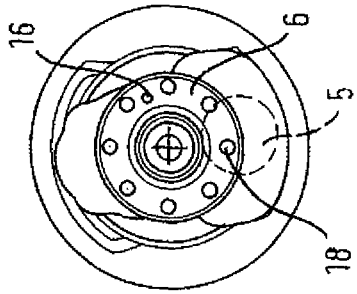
FIG. 2 is an end view pertaining to FIG. 1.

FIG. 2 can give an impression as to how diameter, roundness, true running and centricity are measured and stored point by point for various circumferential angles at the measuring points 11 and 12.

Figure 3:
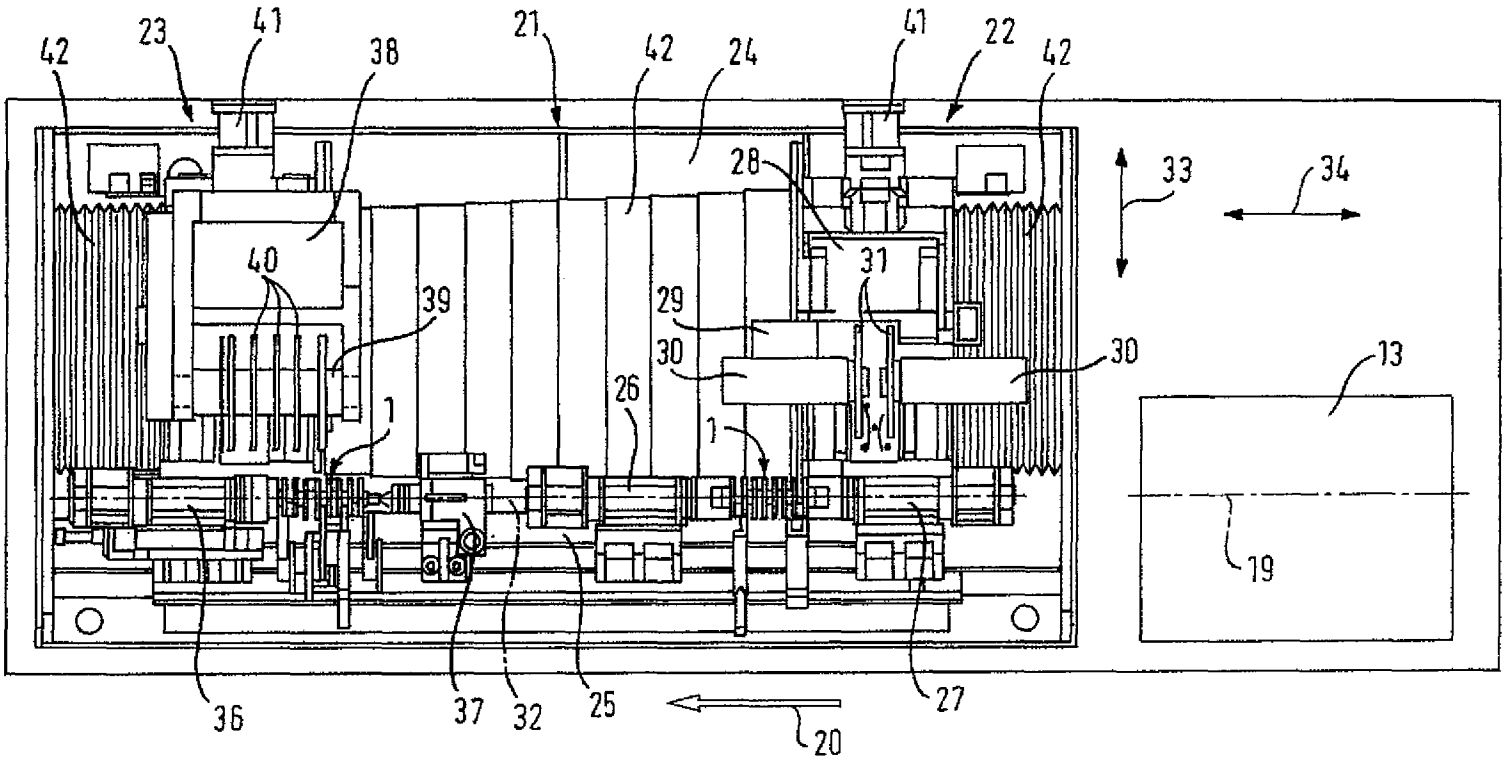
FIG. 3 shows, as an example, an apparatus for carrying out the method according to the invention, in a view from above.

FIG. 3 shows the exemplary arrangement of an apparatus for carrying out the method according to the invention. Since the details of the grinding machines used here are familiar to the person skilled in the art, a schematic general arrangement drawing suffices at this point. In the apparatus combined to form a system, the measuring station 13 is located directly next to a grinding cell 21 which comprises a first grinding station 22 and a second grinding station 23. The two grinding stations 22, 23 are arranged on a common machine bed 24. The machine bed comprises a machine table 25 (which can also be arranged to be displaceable in the direction of the common longitudinal axis 32). Also running in the common longitudinal axis 32 is the axial direction 19 of the crankshaft when the latter is located in the measuring station 13.

A work headstock 26 and a footstock 27, both of which are synchronously driven by electric motor, belong to the first grinding station 22. A crankshaft 1 is clamped between the work headstock 26 and the footstock 27. A cross slide 28 having a wheelhead 29 on which two grinding spindles 30, 31 are located also belongs to the first grinding station 22.

A work headstock 36 and a footstock 37, between which a crankshaft 1 is clamped and rotationally driven, likewise belong to the second grinding station 23. A cross slide 38 belonging to the second grinding station 23 carries, on a common driven spindle 39, a multiple grinding wheel set having grinding wheels 40, which are jointly fed in toward the main bearings 3, 4 during the grinding of the latter. Designated by 41 are drive motors for the infeed spindle of the cross slides 28, 38, and designated by 42 are covers which keep the swarf away from the slideways of the grinding stations 22, 23.

The clamping and driving devices of the two work headstocks 26, 36 and of the two footstocks 27, 37 lie in the common longitudinal axis 32 already mentioned. The longitudinal axis 32 is at the same time the rotation axis (C axis) of the crankshafts 1 during the grinding.

The two cross slides 28, 38 are traversable in the direction of the axis 34, that is to say parallel to the common longitudinal axis 32, and in addition the wheelhead is traversable perpendicularly thereto in the direction of the axis 33 (X axis). The grinding wheels 31, 40 are fed in toward the crankshafts 1 in the direction of the axis 33 during the grinding. Measuring devices (not shown in detail) are provided for operational measurements during the grinding operation.

To carry out the method according to the invention, it is essential that the work headstock 26 and the footstock 27 of the first grinding station 22 be equipped with shell chucks 43. When the crankshaft first machined by chip removal and measured is clamped in shell chucks 43, it does not rotate about its defining geometrical axis when the work headstock 26 and the footstock 27 are being driven, but rather it rotates about a rotation axis 51 which is defined by the outer main bearings 4, from which the crankshaft 1 has been measured. The shell chucks 43 adapt themselves to the two defining outer main bearings 4. This is explained in more detail with reference to FIGS. 4 to 6.

Figure 4:
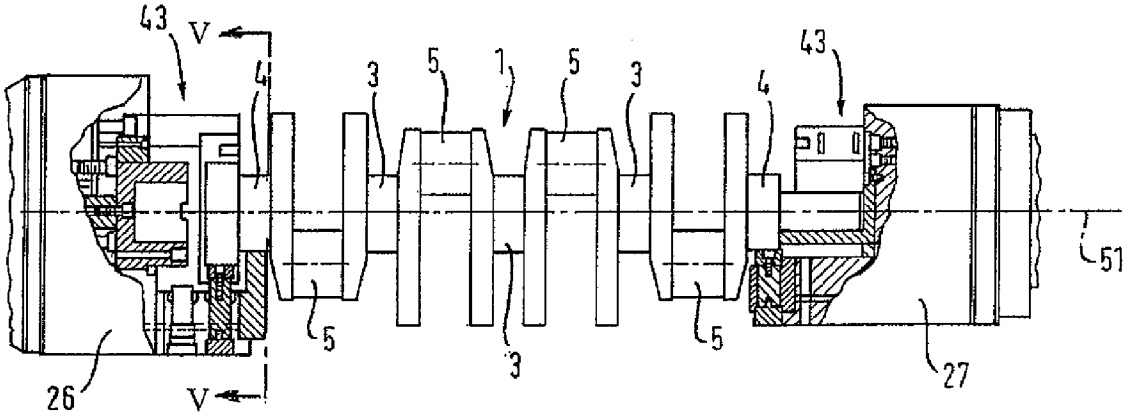
FIG. 4 shows, in a partial longitudinal section, a detail of the apparatus according to FIG. 3 during the grinding of the rod bearings.
Figure 6:
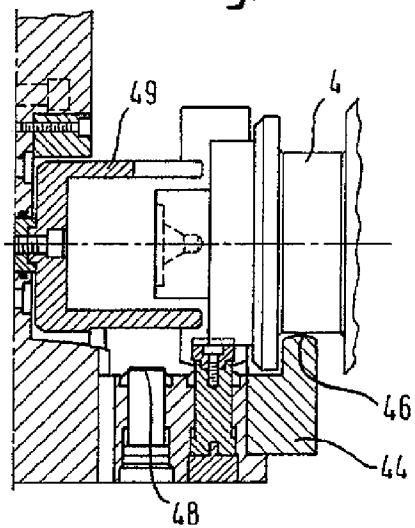
FIG. 6 shows the longitudinal section corresponding to FIG. 5 through a shell chuck.
Figure 5:
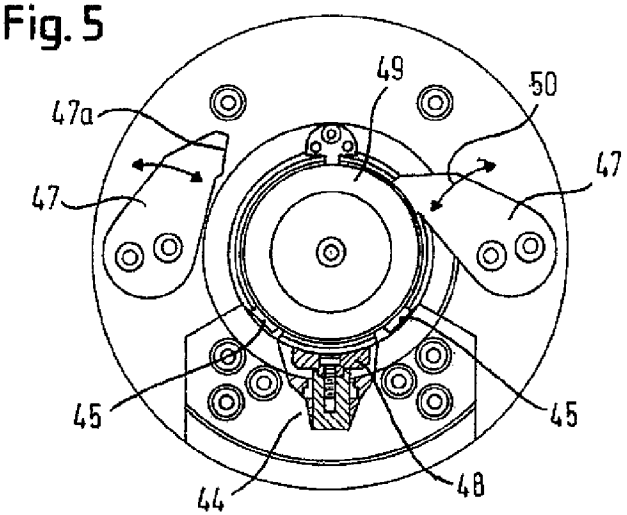
FIG. 5 is an end view of a shell chuck from the illustration according to FIG. 4.

FIG. 4 shows the work headstock 26 and the footstock 27 of the first grinding station 22 together with the clamped crankshaft 1, as has already been described with reference to FIGS. 1 and 2. FIG. 5 shows an enlarged view along section line V-V in FIG. 4. Therefore FIG. 5 shows the end view of the work headstock 26 with details of the shell chuck 43. FIG. 6 is the longitudinal section pertaining to FIG. 5 and is therefore an enlarged partial illustration of FIG. 4. Here, on account of the enlarged illustration, it has been possible to show the flange-side end of the crankshaft 4 with further details, as can be seen from FIGS. 1 and 4.

The essential features of the shell chuck 43 are a supporting shell 44 and two pivotable chuck jaws 47. The supporting shell 44 and the pivotable chuck jaws 47 are all connected to a rotating part of the work headstock 26. The supporting shell 44 has two projections 45, on which the crankshaft 1 rests with its outer main bearings 4. The two pivotable chuck jaws 47 are provided on that side of the shell chuck 43 which is opposite the supporting shell 44, said chuck jaws 47 likewise abutting with projections **47*a* against the outer main bearing 4 of the crankshaft 1. The pivoting direction, lying in the radial plane, of the pivotable chuck jaws 47 is indicated by 50**.

The left-hand pivotable chuck jaw 47 is shown in its raised position and the right-hand chuck jaw 47 is shown in its chucking position in FIG. 5 only for making it easier to understand the functioning. In the firmly clamped state, the crankshafts 1 are therefore clamped at four separate circumferential regions of relatively small circumferential extent, such that four-point clamping may be referred to.

Provided in a position axially offset from the supporting shell 44 is a movable ejector punch 48 which facilitates the removal of the crankshaft 1 from the shell chucks 43. A sleeve 49 also provides a longitudinal stop for exactly fixing the crankshaft 1 in its axial direction.

Since the four projections 45 and 47*a* adapt themselves to the circumference of the outer main bearing 4, the crankshaft 1, during the rotary drive of the work headstock 26 and of the footstock 27, does not rotate about its defining geometrical longitudinal axis 10 but rather about the rotation axis 51 of the shell chuck 43. It becomes especially clear from FIG. 5 that the center point belonging to an eccentrically running, defining geometrical longitudinal axis 10 describes a circular path about the rotation axis 51 of the shell chuck 43 during the rotation of the latter.

FIG. 6 shows that the projections 45 of the supporting shell 44 are relatively narrow in the axial direction and have, for example, an arched contour 46 on their top edge touching the outer main bearing 4. This also applies to the design of the shell chuck 43 on the side of the footstock 27, which in principle is designed in conformity with the shell chuck 43 on the work headstock 26. The projections 47*a* on the pivotable chuck jaws 47 are designed in a manner similar to the projections 45 of the shell chuck 43.

Therefore, in the first grinding station 22, the entire crankshaft 1 is clamped at eight points which are of small circumferential extent and are narrow in the axial direction and are of arched contour 46 for example. The arrangement of these eight clamping regions with a subdivision into two groups located at a distance from one another means that the crankshaft 1 can assume small inclinations during rotation in the first grinding station if the deviation of the rotation axis 51 from the defining geometrical longitudinal axis 10 in the two outer main bearings 4 varies. A relatively slight inclination can then occur without constraints or stresses occurring in the crankshaft 1. The clamping by means of shell chucks results in rigid firm clamping and reliable rotary drive of the crankshaft without an axial pressure being exerted thereon.

Another type of setup is required in the second grinding station 23 of the grinding cell 21 if the method according to the invention is to be carried out. The crankshaft 1 must be clamped between locating centres 52, 53 in the second grinding station 23, as can be seen from FIG. 7. The centering bore 8 on the flange 6 and the centering bore 9 on the journal 7 are now used. The locating center 52 is located on the work headstock 36 and the locating center 53 is located on the footstock 37.

Figure 8:
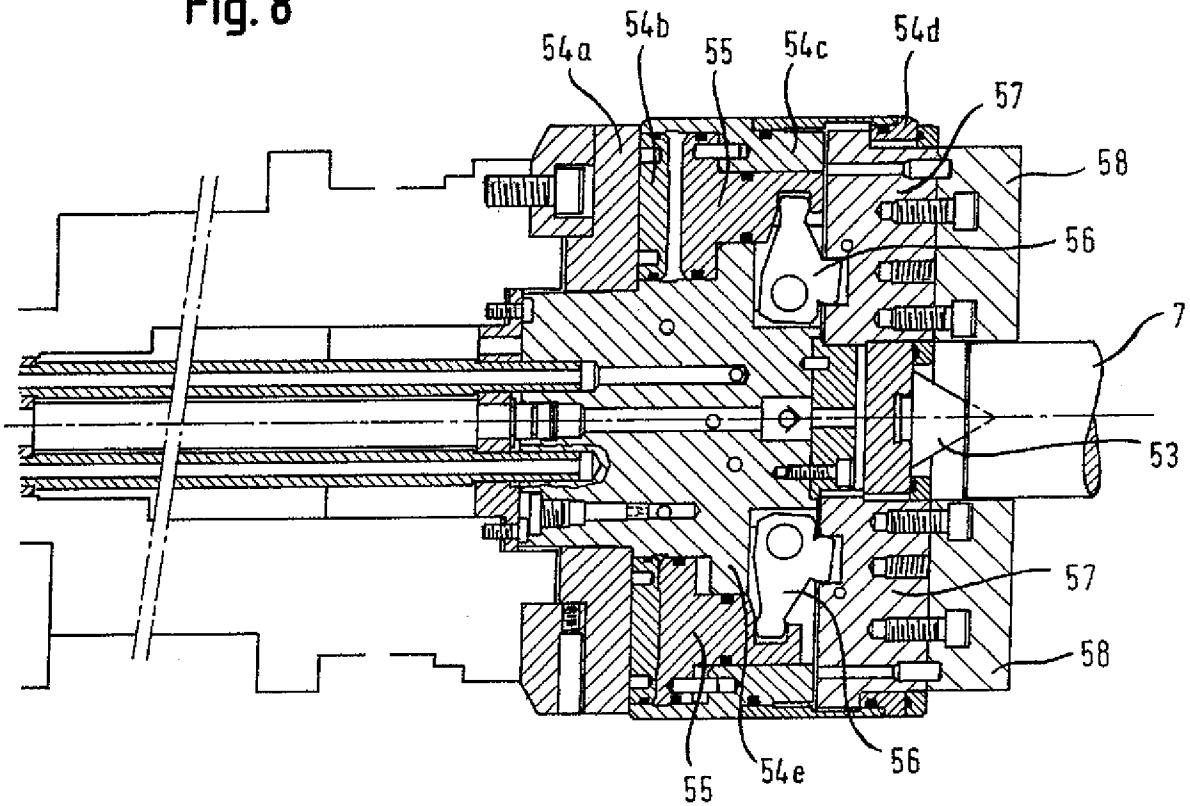
FIG. 8 illustrates details of the compensating chuck required during the grinding operation according to FIG. 7.

The crankshaft 1 clamped between the locating centers 52, 53 is rotationally driven by a drive having a compensating chuck. FIG. 8 shows an example of such a rotary drive. In this case, axially freely movable actuating pistons 55 are provided between housing parts 54*a* to 54*e* of the work headstock 36 and if need be of the footstock 37, said actuating pistons 55 acting on radially movable radial slides 57 via pivotably mounted bell-crank levers 56. The radial slides 57 are screwed to chuck jaws 58 which act on a circumferential surface of the crankshaft 1. The circumferential surface can be located on, for example, a flange 6 or journal 7. In the second grinding station 23, first of all the crankshaft 1 must be accommodated between the locating centers 52, 53 of the work headstock 36 and the footstock 37. The chuck jaws 58 are then moved up to the available circumferential surface, in this case to the circular circumference of the journal 7. To this end, all the actuating pistons 55 are actuated with a pressure medium, such as hydraulic oil or compressed air for example, from a common source. Although the actuating pistons 55 can be moved individually on their own, they can compensate for one another via the pressure medium. Each chuck jaw 58 is therefore moved up to the journal 7 only to such an extent that the requisite contact pressure is ensured.

In the second grinding station 23, therefore, the rotation axis of the work headstock 36 and of the footstock 37 is identical to the defining geometrical longitudinal axis 10 of the crankshaft 1 as established by the centering bores 8 and 9.

Figure 7:
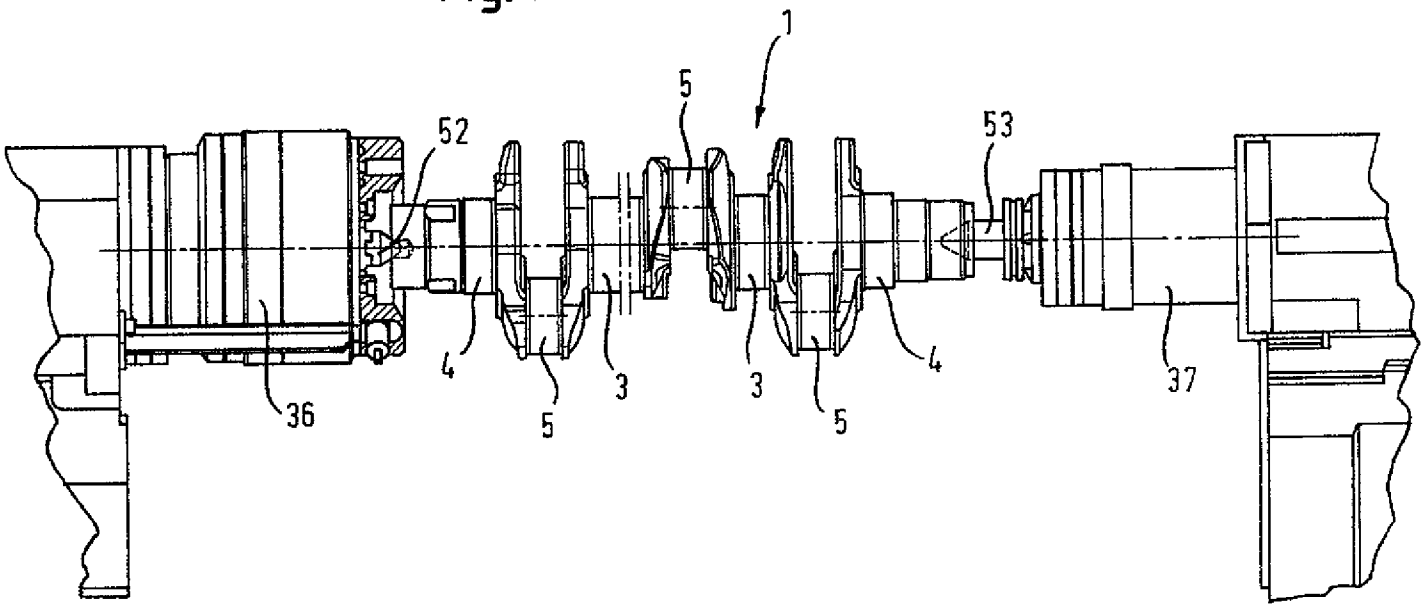
FIG. 7 is an illustration of the conditions during the subsequent grinding of the main bearings.

It may also be noted that the illustration of the crankshaft 1 and also the spatial direction of work headstock or footstock in FIGS. 7 and 8 differ partly from the illustration in the preceding figures; but this does not affect the explanation of the principle.

The way in which the method according to the invention takes place on the system described above is described below.

The direction of flow 20 of the crankshafts 1 is depicted in FIG. 3. The measuring station 13 and the grinding cell 21 are loaded and unloaded by a loading gantry. The crankshafts 1 are introduced into the measuring station 13 from outside and, after completion of the measuring operation, are first of all transferred to the first grinding station 22, in which the rod bearings 5 are finish-ground. After that, the crankshafts 1 are transported to the second grinding station 23, in which the main bearings 3, 4 of the crankshaft 1 are finish-ground. The finish-ground crankshafts 1 are then unloaded again from the grinding cell 21 to the outside using the same loading gantry.

When a crankshaft 1 is fed to the measuring station 13, it is merely machined by chip removal, the main and rod bearings 3, 4, 5 being pre-machined and requisite bores being incorporated. Furthermore, the centering bores 8 and 9 which establish and identify the defining geometrical longitudinal axis 10 on the crankshaft 1 are already present. In this state of the crankshaft, the inner and outer main bearings 3, 4 are still defective with regard to the diameter, the roundness and the centricity due to the preparation.

In the first grinding station 22, the crankshaft 1, with regions which lie in the common longitudinal extent of the main bearings 3, 4, is clamped in the shell chucks 43 of the work headstock 26 and of the footstock 27. In the exemplary embodiment, the clamping is effected in both outer main bearings 4. Due to the rotary drive, the crankshaft 1 rotates about the rotation axis 51, which is defined by the defective contour of the two outer main bearings 4. Starting from this rotation, the rod bearings 5 of the crankshaft 1 are rough- and finish-ground in a continuous operation in the first grinding station 22. The deviation of the actual rotation axis 51 from the defining geometrical longitudinal axis 10 of the crankshaft 1 is taken into account in the computer of the first grinding station 22. The grinding is effected by the pin-chasing grinding process. Nonetheless, by virtue of the fact that a correction is made in accordance with the stored measurement of the crankshaft 1 during each infeed movement, the rod bearings 5 are in effect ground in strict relationship to the defining geometrical longitudinal axis 10 of the crankshaft 1. The finish-ground rod bearings 5 then have an exact reference to main bearings 3, 4 of the crankshaft 1, which would be strictly ground according to the defining geometrical longitudinal axis 10 of the crankshaft 1.

It is not absolutely necessary for the crankshaft 1 to be clamped at the outer main bearings 4 in the first grinding station 22. Depending on the type of construction of the crankshaft, other main bearings 3 can also be used for the measuring and the clamping, and likewise flange 6 and journal 7, because the latter are provided concentrically to the main bearings 3, 4. During the grinding of the rod bearings 5 in the first grinding station 22, it is not necessary to additionally support the crankshaft 1 by steady rests.

In the present exemplary embodiment, the grinding of a crankshaft 1 having four rod bearings 5 is envisaged. In this type of construction, as a rule two rod bearings 5 each have the same phase position with respect to the defining geometrical longitudinal axis 10 of the crankshaft 1. Therefore two rod bearings 5 each are jointly ground; as a rule these are, in pairs, the inner rod bearings 5 and the outer rod bearings 5; but phase-displaced rod bearings can also be ground simultaneously. When changing over from the grinding of the inner rod bearings 5 to the grinding of the outer rod bearings 5, the two grinding spindles 30 on the cross slide 28 must be moved apart, and vice versa.

However, the arrangement, shown in the exemplary embodiment, of the grinding wheels 30 in the first grinding station 22 is not absolutely necessary. If required by the type of construction of the crankshaft 1, the rod bearings 5 can also be finish-ground individually and one after the other using a single grinding wheel.

The rod bearings 5 are measured during the grinding by means of in-process measuring heads, the diameter of the rod bearings 5 to be ground being measured continuously during the grinding. The diameter and roundness correction is made via the measuring head as a measured value on the rod bearing 5 to be ground and is compared with the desired value via the machine control. A dimensional correction in the direction of the axis 33 (X axis) is then carried out during the infeed movement. It is also possible to perform a correction movement of the second grinding spindle 30 as a function of the infeed movement of the first grinding spindle 30.

Furthermore, it is important that the roundness, produced at the finish-ground rod bearing 5, of the bearing point can be checked. This can likewise be measured in the first grinding station 22; a correspondingly corrected path in the direction of the axis 33 is then controlled during the pin-chasing grinding process, as a result of which an optimally round rod bearing 5 can be achieved.

When all the rod bearings 5 are finish-ground, the stresses and the distortion due to the grinding operation have been largely removed and will no longer crucially affect the true-running accuracy of the main bearings 3, 4. After that, the crankshaft 1 is transferred into the second grinding station 23 by means of the loading gantry. The centering bores 8 and 9 at the ends of the crankshaft 1 are now used, as shown in FIGS. 7 and 8. The main bearings 4 have still not been ground. Regions of the crankshaft 1 which lie in the common longitudinal extent of the main bearings 3, 4 are now used for the rotary drive. The chuck jaws 58 abut against the diameter of these regions of the crankshaft to a varying degree. However, the rotation is effected strictly about the defining geometrical longitudinal axis 10, which coincides with the axial direction of the two locating centers 52 and 53. In the second grinding station 23, the crankshaft 1 is advantageously supported with a centering steady rest on at least one main bearing 3. A plurality of centering steady rests can also be used. Furthermore, the diameter is measured at a plurality of main bearings 3, 4, such that the crankshaft is ground to the desired specified size by means of an "in-process measurement". The crankshaft 1 is therefore machined at its main bearings 3, 4 until it is ground to finished size.

In the exemplary embodiment selected, a multiple grinding wheel set having grinding wheels 40 is provided for grinding the main bearings, such that a plurality of main bearings 3, 4 can be ground simultaneously. During the grinding of the main bearings 3, 4, the multiple grinding wheel set is fed in to the main bearings 3, 4 in the direction of the axis 33 (X axis). However, the multiple grinding wheel set is also traversable on the cross slide 38 in the direction of the axis 34 (Z axis) parallel to the direction of the common longitudinal axis 25. This arrangement permits the use of grinding wheels which are narrower than the main bearings 3, 4 to be ground. Furthermore, the diamond dressing wheel can thereby also be advanced for dressing the grinding wheels. The main bearings 3, 4 are also rough- and finish-ground in a single operation. Specifically defined portions of the main bearings 3, 4 can also be face-ground by the displacement in the direction of the axis 34.

The rod bearings 5 must always be ground in a CNC-controlled manner for the method according to the invention. But a CNC control is also always advantageous for the grinding of the main bearings 3, 4.

The use of a multiple grinding wheel set is likewise not absolutely necessary during the grinding of the main bearings 3, 4. If required by the type of crankshaft or by an existing grinding machine, the main bearings can likewise be ground individually and one after the other using a single grinding wheel.

When the crankshaft 1 has passed through the second grinding station 23, the main bearings 3, 4 also have the best possible roundness values, since no further grinding operation takes place on the main and rod bearings 3, 4, 5. The crankshaft is then removed from the grinding cell 21 in the direction of flow 20 by means of the loading gantry.

The system shown in the exemplary embodiment having a combination of measuring station 13 and grinding cell 21 is an especially economical option for carrying out the method according to the invention in mass production. If required by the circumstances, however, the measuring and the various grinding operations can also be carried out at separate locations and on separate equipment or grinding machines.

The invention claimed is:

1. A method for grinding main bearings and pin bearings of a crankshaft using out-of-round grinding, comprising the following method steps:

a) clamping the crankshaft in a grinding machine in a first clamping at one of a first location comprising two unground main bearings of the crankshaft, which two unground main bearings are spaced from one another in a common longitudinal extension of the two unground main bearings or at a second location comprising two end-side cylindrical segments located on a common longitudinal extension of the two unground main bearings;

b) rotating the crankshaft about a rotational axis defined by the two unground main bearings that deviates from a determined geometric longitudinal axis of the crankshaft that runs through the main bearings;

c) grinding the pin bearings to preselected final dimensions during rotation of the crankshaft with out-of-round grinding employing pin-chasing grinding implemented by CNC-control;

d) positioning grinding wheels of the grinding machine during pin-chasing grinding according to the determined geometric longitudinal axis, using the deviation of the grinding wheels from the rotational axis as a correction value corresponding to the magnitude of deviation between the rotational axis and the determined geometric longitudinal axis so that a computer implementing CNC control effects grinding of the pin bearings according to the determined geometrical longitudinal axis of the crankshaft, measurements of the crankshaft defining the determined geometric longitudinal axis being transferred to the computer implementing the CNC control so that said computer can calculate said correction value;

changing the clamping of the crankshaft to a second clamping in which the crankshaft is clamped at axial ends of the crankshaft and rotating the crankshaft about the determined geometric longitudinal axis; and grinding the main bearings to preselected final dimensions, using out-of-round grinding.

2. The method of claim 1, wherein the method further comprises:

a.) rough-machining a blank for the crankshaft prior to the grinding of the pin bearings, whereby a rough-machined crankshaft is provided for the first clamping;

b.) measuring the diameter, roundness, and centricity of the bearings of the rough-machined crankshaft provided for the first clamping;

c.) determining the position of the geometric longitudinal axis from the measured values with respect to the bearings, whereby a determined geometric longitudinal axis is provided and determining a correction value for pin-chasing grinding.

3. The method of claim 1 further comprising providing centering bores on the end faces of the crankshaft, clamping the crankshaft in the grinding machine, and determining the geometric longitudinal axis of the crankshaft, whereby a determined geometric longitudinal axis is provided.

4. The method of claim 3 further comprised of establishing a reference line extending radially from the determined geometric longitudinal axis for the angular position of measured values of the diameter, roundness, and centricity of the bearings, and measuring a reference bore for the angular position in an end face of the crankshaft.

5. The method of claim 3 further comprising clamping the crankshaft between two centers during the clamping of the crankshaft in the second clamping, and rotating the crankshaft at a crankshaft end positioned on a side of a workpiece headstock, wherein the crankshaft is rotated using a catch and drive device.

6. The method of claim 1, wherein the crankshaft is clamped in the first clamping at the two outer main bearings.

7. The method of claim 1, wherein the crankshaft is clamped in the first clamping at the end-side cylindrical segments.

8. The method of claim 1 further comprising, during the first clamping, retaining the two unground main bearings in shell chucks, and rotating the crankshaft at axial ends of the crankshaft.

9. The method of claim 1 wherein the pin bearings of the crankshaft are ground simultaneously employing the pin-chasing grinding.

10. The method of claim 1 wherein the grinding of the main bearings is facilitated by CNC control.

11. The method of claim 1, wherein, in the second clamping, the main bearings are ground using a grinding wheel set having multiple grinding wheels disposed and driven on a common axis, the multiple grinding wheels each having the same diameter.

12. The method of claim 1, wherein, in the second clamping, the main bearings are ground with a single grinding wheel that is successively positioned against each of the main bearings.

13. The method of claim 1, wherein, in the second clamping, positioning a centering steady is positioned against at least one of the main bearings during the grinding of the main bearings.

14. An apparatus for performing the method for grinding the main and the pin bearings of a crankshaft using out-of-round grinding, the apparatus comprising:

a.) a first grinding station having a workpiece headstock and a tailstock, wherein each of the headstock and tailstock are provided with shell chucks;

b.) a compound slide rest provided at the first grinding station having at least one grinding spindle that has at least one grinding wheel driven to rotate and can be moved, by a CNC controller, in two directions, the first direction being the positioning direction for the grinding wheel extending perpendicular to the rotational axis formed by the workpiece headstock and the tailstock, and the second direction extending parallel to the rotational axis;

c.) the CNC controller for the first grinding station being in connection with and in control of the grinding wheel, wherein, upon positioning the grinding wheel against a pin bearing of a crankshaft that is borne in the longitudinal extension of its main bearings in the shell chucks and driving the crankshaft to rotate, the CNC controller uses a deviation value between the actual rotational axis provided by the shell chucks and the determined geometrical longitudinal axis of the crankshaft so that the pin bearings are ground according to the determined geometric longitudinal axis, measurements of the crankshaft defining the determined geometric longitudinal axis being transferred to the CNC controller so that said controller can calculate said deviation value;

d.) a second grinding station having a workpiece headstock and a tailstock, each of the headstock and tailstock being provided with centers, the centers being matched to center bores provided on end faces of the crankshaft, which centers correspond to the determined geometric longitudinal axis; and e.) a device for rotationally driving the workpiece headstock of the second grinding station, whereby, in the second grinding station, the main bearings of the crankshaft are ground while the crankshaft is rotating about the determined geometric longitudinal axis.

15. The apparatus of claim 14, further comprising a measuring station and a grinding cell including the first and the second grinding stations, whereby a system and a transport device is provided that successively supplies a crankshaft ready for grinding, first to the measuring station, then to the first grinding station, then to the second grinding station, and then to outside the apparatus, whereby a finish-ground crankshaft is provided.

* * * * *